US006173870B1

(12) United States Patent
Taylor

(10) Patent No.: US 6,173,870 B1
(45) Date of Patent: Jan. 16, 2001

(54) OPERATING HANDLE DEVICE FOR A PRESSURIZED CHEESE DISPENSING CONTAINER

(76) Inventor: Thomas A. Taylor, 4548 E. County Road. J, Beloit, WI (US) 53511

( * ) Notice: Under 35 U.S.C. 154(b), the term of this patent shall be extended for 0 days.

(21) Appl. No.: 09/591,057

(22) Filed: Jun. 9, 2000

(51) Int. Cl.[7] ..... B65D 83/00
(52) U.S. Cl. ..... 222/402.15; 222/402.21
(58) Field of Search ..... 222/323, 402.15, 222/402.21

(56) References Cited

U.S. PATENT DOCUMENTS 3,648,905 * 3/1972 Kauder ..... 222/402.21
3,987,942 * 10/1976 Morane et al. ..... 222/402.15
4,428,512 * 1/1984 Nosek ..... 222/402.15

* cited by examiner

*Primary Examiner*—Philippe Derakshani

(57) ABSTRACT

A operating handle device for a pressurized cheese dispensing container for actuating the dispensing system of a cheese dispensing container. The operating handle device for a pressurized cheese dispensing container includes a tubular member. The tubular member has a pair of open ends. A peripheral wall extends between the open ends. Each of the open ends has perimeter edge. The tubular member has a break therein. The break generally extends between the open ends. The tubular member has a size adapted to removably receive the container. A protruding member is integrally attached to and extends away from the peripheral wall of the tubular member. The protruding member is positioned generally adjacent to a first of the open ends of the tubular member and generally opposite of the break. The protruding member has a slot therein. An actuating means for actuating the dispensing tube of the container comprises a rod. The rod is positioned in the slot in the protruding member and hingedly coupled thereto. The rod has a opening therethrough. The opening is adjacent to a free end of the rod positioned generally adjacent to the first open end. The dispensing tube is removably extendable through the opening.

6 Claims, 2 Drawing Sheets

OPERATING HANDLE DEVICE FOR A PRESSURIZED CHEESE DISPENSING CONTAINER

BACKGROUND OF THE INVENTION

1. Field of the Invention

The present invention relates to pressurized container operating handle devices and more particularly pertains to a new operating handle device for a pressurized cheese dispensing container for actuating the dispensing system of a cheese dispensing container.

2. Description of the Prior Art

The use of pressurized container operating handle devices is known in the prior art. More specifically, pressurized container operating handle devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,401,240; 3,734,357; 4,579,258; 3,122,849; U.S. Des. Pat. No. 283,801; and U.S. Pat. No. 3,506,159.

While these devices fulfill their respective, particular objectives and requirements, the aforementioned patents do not disclose a new operating handle device for a pressurized cheese dispensing container. The inventive device includes a tubular member. The tubular member has a pair of open ends. A peripheral wall extends between the open ends. Each of the open ends has perimeter edge. The tubular member has a break therein. The break generally extends between the open ends. The tubular member has a size adapted to removably receive the container. A protruding member is integrally attached to and extends away from the peripheral wall of the tubular member. The protruding member is positioned generally adjacent to a first of the open ends of the tubular member and generally opposite of the break. The protruding member has a slot therein. An actuating means for actuating the dispensing tube of the container comprises a rod. The rod is positioned in the slot in the protruding member and hingedly coupled thereto. The rod has a opening therethrough. The opening is adjacent to a free end of the rod positioned generally adjacent to the first open end. The dispensing tube is removably extendable through the opening.

In these respects, the operating handle device for a pressurized cheese dispensing container according to the present invention substantially departs from the conventional concepts and designs of the prior art, and in so doing provides an apparatus primarily developed for the purpose of actuating the dispensing system of a cheese dispensing container.

SUMMARY OF THE INVENTION

In view of the foregoing disadvantages inherent in the known types of pressurized container operating handle devices now present in the prior art, the present invention provides a new operating handle device for a pressurized cheese dispensing container construction wherein the same can be utilized for actuating the dispensing system of a cheese dispensing container.

The general purpose of the present invention, which will be described subsequently in greater detail, is to provide a new operating handle device for a pressurized cheese dispensing container apparatus and method which has many of the advantages of the pressurized container operating handle devices mentioned heretofore and many novel features that result in a new operating handle device for a pressurized cheese dispensing container which is not anticipated, rendered obvious, suggested, or even implied by any of the prior art pressurized container operating handle devices, either alone or in any combination thereof.

To attain this, the present invention generally comprises a tubular member. The tubular member has a pair of open ends. A peripheral wall extends between the open ends. Each of the open ends has perimeter edge. The tubular member has a break therein. The break generally extends between the open ends. The tubular member has a size adapted to removably receive the container. A protruding member is integrally attached to and extends away from the peripheral wall of the tubular member. The protruding member is positioned generally adjacent to a first of the open ends of the tubular member and generally opposite of the break. The protruding member has a slot therein. An actuating means for actuating the dispensing tube of the container comprises a rod. The rod is positioned in the slot in the protruding member and hingedly coupled thereto. The rod has a opening therethrough. The opening is adjacent to a free end of the rod positioned generally adjacent to the first open end. The dispensing tube is removably extendable through the opening.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new operating handle device for a pressurized cheese dispensing container apparatus and method which has many of the advantages of the pressurized container operating handle devices mentioned heretofore and many novel features that result in a new operating handle device for a pressurized cheese dispensing container which is not anticipated, rendered obvious, suggested, or even implied by any of the prior art pressurized container operating handle devices, either alone or in any combination thereof.

It is another object of the present invention to provide a new operating handle device for a pressurized cheese dispensing container which may be easily and efficiently manufactured and marketed.

It is a further object of the present invention to provide a new operating handle device for a pressurized cheese dispensing container which is of a durable and reliable construction.

An even further object of the present invention is to provide a new operating handle device for a pressurized cheese dispensing container which is susceptible of a low cost of manufacture with regard to both materials and labor, and which accordingly is then susceptible of low prices of sale to the consuming public, thereby making such operating handle device for a pressurized cheese dispensing container economically available to the buying public.

Still yet another object of the present invention is to provide a new operating handle device for a pressurized cheese dispensing container which provides in the apparatuses and methods of the prior art some of the advantages thereof, while simultaneously overcoming some of the disadvantages normally associated therewith.

Still another object of the present invention is to provide a new operating handle device for a pressurized cheese dispensing container for actuating the dispensing system of a cheese dispensing container.

Yet another object of the present invention is to provide a new operating handle device for a pressurized cheese dispensing container which includes a tubular member. The tubular member has a pair of open ends. A peripheral wall extends between the open ends. Each of the open ends has perimeter edge. The tubular member has a break therein. The break generally extends between the open ends. The tubular member has a size adapted to removably receive the container. A protruding member is integrally attached to and extends away from the peripheral wall of the tubular member. The protruding member is positioned generally adjacent to a first of the open ends of the tubular member and generally opposite of the break. The protruding member has a slot therein. An actuating means for actuating the dispensing tube of the container comprises a rod. The rod is positioned in the slot in the protruding member and hingedly coupled thereto. The rod has a opening therethrough. The opening is adjacent to a free end of the rod positioned generally adjacent to the first open end. The dispensing tube is removably extendable through the opening.

Still yet another object of the present invention is to provide a new operating handle device for a pressurized cheese dispensing container that is retrofittable to existing dispensers and is readily re-usable.

Even still another object of the present invention is to provide a new operating handle device for a pressurized cheese dispensing container that allows persons having weakness in their hands to dispense cheese product from a cheese dispensing container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
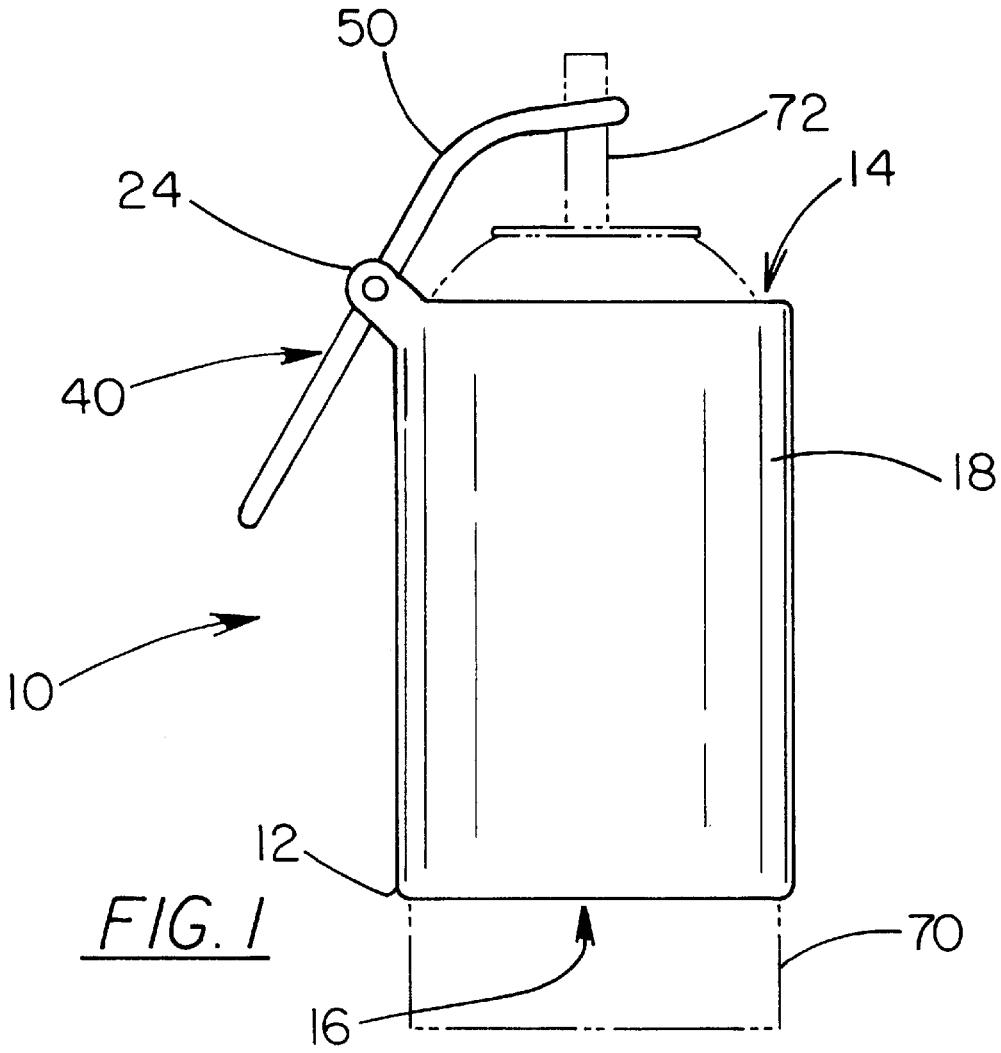
FIG. 1 is a schematic side view of a new operating handle device for a pressurized cheese dispensing container according to the present invention.

With reference now to the drawings, and in particular to FIGS. 1 through 4 thereof, a new operating handle device for a pressurized cheese dispensing container embodying the principles and concepts of the present invention and generally designated by the reference numeral 10 will be described.

As best illustrated in FIGS. 1 through 4, the operating handle device for a pressurized cheese dispensing container 10 generally comprises a device for a dispensing container 70 having a tubular body. The container 70 has a top side having a dispensing tube 72 vertically extending out thereof.

The device includes a tubular member 12. The tubular member 12 has a pair of open ends 14, 16. A peripheral wall 18 extends between the open ends 14, 16. Each of the open ends 14, 16 has perimeter edge 20. The tubular member 12 has a break 22 therein. The break 22 generally extends between the ends 14, 16. The tubular member has an arcuate cross-section taken transverse to a longitudinal axis of the tubular member. The tubular member 12 has a size adapted to removably receive the container 70. The tubular member 12 comprises a resiliently flexible material. The resiliently flexible material comprising a plastic.

A protruding member 24 is integrally attached to and extends away from the peripheral wall 18 of the tubular member 12. The protruding member 24 is positioned generally adjacent to a first 14 of the open ends of the tubular member 12 and generally opposite of the break 22. The protruding member 24 has a slot 26 therein.

An arcuate member 28 has a first end 30 and a second end 32. Each of the ends 30, 32 of the arcuate member 28 is integrally coupled to the perimeter edge 20 of the first open end 14 such that the arcuate member 28 extends away from the tubular member 12. The arcuate member 27 is positioned nearer the protruding member 24 than the break 22. The arcuate member 28 lies in a plane oriented generally perpendicular to a plane of the perimeter edge 20 of the first open end 14 and to a line extending between the break 22 and the protruding member 24. The arcuate member 28 has an apex 34. The apex 34 has a hole 36 therethrough having an axis oriented generally parallel to the plane of the perimeter edge 20.

An actuating means actuates the dispensing tube. The actuating means comprises a rod 40. The rod 40 has a first portion 42 and a second portion 44 hingedly coupled together at their ends. The first portion 42 is positioned in the slot 26 in the protruding member 24 and is hingedly coupled thereto. The second portion 44 is extendable through the hole 36 in the arcuate member 28. The second portion 44 has an opening 46 therethrough. The opening 46 is adjacent to a free end 48 of the second portion 44. The dispensing tube 72 is removably extendable through the opening 46.

Figure 2:
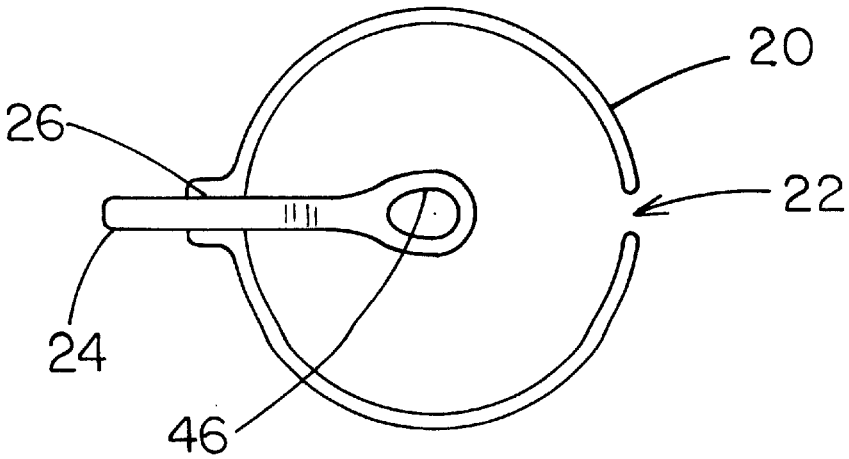
FIG. 2 is a schematic top view of the present invention.
Figure 3:
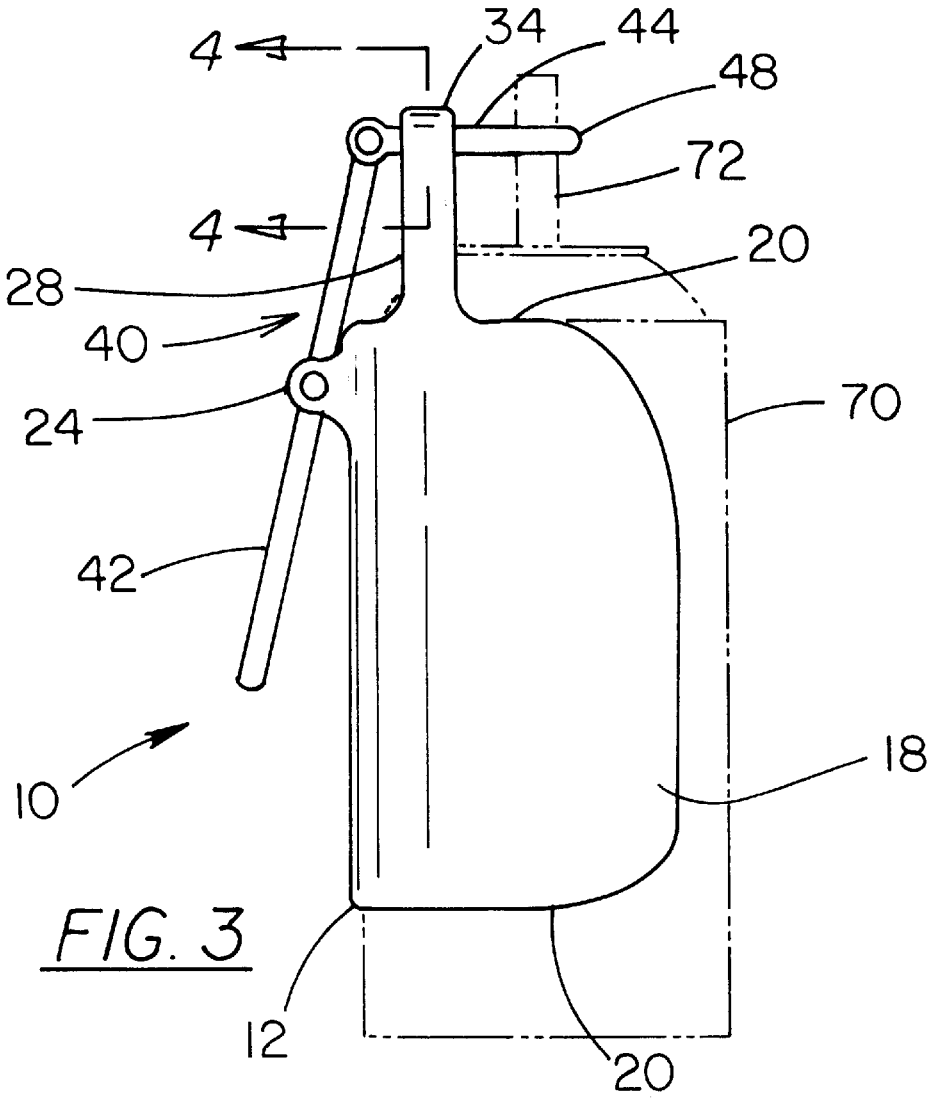
FIG. 3 is a schematic side view of the present invention.
Figure 4:
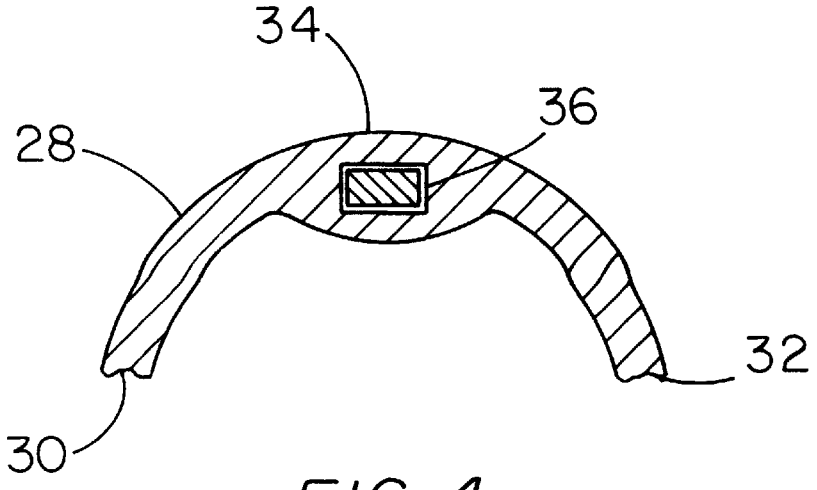
FIG. 4 is a schematic cross-sectional view taken along line 4—4 of the present invention.

A second embodiment to the one described above and depicted in FIGS. 3 and 4 is shown if FIGS. 1 and 2. In the second embodiment, no arcuate member 28 exists and the protruding member 24 extends in an angular relationship with respect to the peripheral wall 18. The protruding member 24 comprises an angle with a plane of the perimeter edge 20 of the first open end 14 generally between 120 and 150 degrees. The rod 40 in the second embodiment is one continuous rod. The rod 40 has a bend 50 therein. The bend 50 is between the opening 46 in the rod 40 and the protruding member 24. The bend 50 comprises an angle between 120 and 150 degrees such that the rod bends toward the break 22.

In use, the tubular member 12 is placed over a conventional cheese dispensing container 70 and the dispensing tube 72 is placed in the opening 46 of the rod 40. The opposite end of the rod, with respect to the opening, is pressed toward the tubular member 12 which causes the opening 48 to be pulled toward the protruding member 24. This in turn places the dispensing tube 72 in an angular relationship with the container 70 and opens the valve in the container 70 such that the cheese product is dispensed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An operating handle device for a pressurized cheese dispensing container, the container having a tubular body, the container having a top side having a dispensing tube vertically extending out thereof, said device comprising:

a tubular member, said tubular member having a pair of open ends, a peripheral wall extending between said open ends, each of said open ends having perimeter edge, said tubular member having a break therein, said break generally extending between said open ends, said tubular member having a size adapted to removably receive the container;

a protruding member, said protruding member being integrally attached to and extending away from said peripheral wall of said tubular member, said protruding member being positioned generally adjacent to a first of said open ends of said tubular member and generally opposite of said break, said protruding member having a slot therein; and an actuating means for actuating said dispensing tube, said actuating means comprising a rod, said rod being positioned in said slot in said protruding member and hingedly coupled thereto, said rod having a opening therethrough, said opening being adjacent to a free end of said rod positioned generally adjacent to said first open end, wherein said dispensing tube is removably extendable through said opening.

2. The operating handle device as in claim 1, wherein said protruding member extends in an angular relationship with respect to said peripheral wall, said protruding member comprising an angle with a plane of said perimeter edge of said first open end generally between 120 and 150 degrees.

3. The operating handle device as in claim 2, wherein said rod has a bend therein, said bend being between said opening in said rod and said protruding member, said bend comprising and angle between 120 and 150 degrees such that said rod bends toward said break.

4. The operating handle device as in claim 1, wherein said tubular member further comprises:

said tubular member having an arcuate cross-section taken transverse to a longitudinal axis of said tubular member, said tubular member comprising a resiliently flexible material, said resiliently flexible material comprising a plastic.

5. The operating handle device as in claim 1, further comprising:

an arcuate member, said arcuate member having a first end and a second end, each of said ends of said arcuate member being integrally coupled to said perimeter edge of said first open end such that said arcuate member extends away from said tubular member, said arcuate member being positioned nearer said protruding member than said break, said arcuate member having an apex, said apex having a hole therethrough having an axis oriented generally parallel to a plane of said perimeter edge; and said rod having a first portion and a second portion hingedly coupled together at their ends, said first portion being positioned in said slot in said protruding member and hingedly coupled thereto, said second portion being extendable through said hole in said arcuate member, said second portion having said opening therethrough, said opening being adjacent to a free end of said second portion.

6. An operating handle device for a pressurized cheese dispensing container, the container having a tubular body, the container having a top side having a dispensing tube vertically extending out thereof, said device comprising:

a tubular member, said tubular member having a pair of open ends, a peripheral wall extending between said open ends, each of said open ends having perimeter edge, said tubular member having a break therein, said break generally extending between said open ends, said tubular member having an arcuate cross-section, said tubular member having a size adapted to removably receive the container, said tubular member comprising a resiliently flexible material, said resiliently flexible material comprising a plastic;

a protruding member, said protruding member being integrally attached to and extending away from said peripheral wall of said tubular member, said protruding member being positioned generally adjacent to a first of said open ends of said tubular member and generally opposite of said break, said protruding member having a slot therein;

an arcuate member, said arcuate member having a first end and a second end, each of said ends of said arcuate member being integrally coupled to said perimeter edge of said first open end such that said arcuate member extends away from said tubular member, said arcuate member being positioned nearer said protruding member than said break, said arcuate member lying in a plane oriented generally perpendicular a plane of said perimeter edge of said first open end and to a line extending between said break and said protruding member, said arcuate member having an apex, said apex having a hole therethrough having an axis oriented generally parallel to said plane of said perimeter edge; and an actuating means for actuating said dispensing tube, said actuating means comprising a rod, said rod having a first portion and a second portion hingedly coupled together at their ends, said first portion being positioned in said slot in said protruding member and hingedly coupled thereto, said second portion being extendable through said hole in said arcuate member, said second portion having a opening therethrough, said opening being adjacent to a free end of said second portion, wherein said dispensing tube is removably extendable through said opening.

* * * * *